United States Patent [19]

Dechelette

[11] 4,045,114

[45] Aug. 30, 1977

[54] METHOD OF MANUFACTURING AN ELECTRICAL CONNECTOR

[75] Inventor: Hélen Dechelette, St. Cloud, France

[73] Assignee: AMP Incorporated, Harrisburg, Pa.

[21] Appl. No.: 681,294

[22] Filed: Apr. 28, 1976

[30] Foreign Application Priority Data

May 5, 1975 France ..... 75.13936

[51] Int. Cl.[2] ..... H01R 13/50

[52] U.S. Cl. ..... 339/210 M; 29/629; 29/630 A

[58] Field of Search ..... 29/628, 629, 630 A, 29/630 B, 630 C, 630 D; 339/17 F, 47 R, 49 R, 166 R, 176 MF, 210 M, 61 M, 153, 198 E, 198 G, 198 GM

[56] References Cited

U.S. PATENT DOCUMENTS

| | | | |
|---|---|---|---|
| 3,262,082 | 7/1966 | Gammel | 29/629 |
| 3,485,982 | 12/1969 | Maire | 29/630 B |
| 3,727,170 | 4/1973 | Mosier et al. | 339/17 F |

*Primary Examiner*—Lowell A. Larson
*Attorney, Agent, or Firm*—Allan B. Osborne

[57] ABSTRACT

An electrical connector comprising a housing and a contact having a part lying on a planar surface of the housing is manufactured by a method involving arranging the contact on a first housing part and then bonding a second housing part to the first housing part to secure the contact in the required position.

3 Claims, 7 Drawing Figures

FIG. 1.
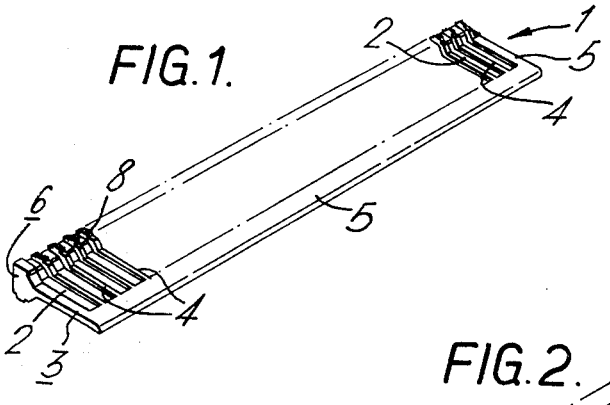
FIG. 2.
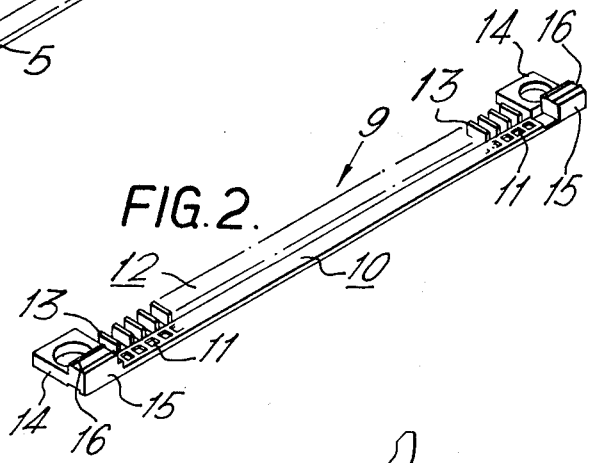
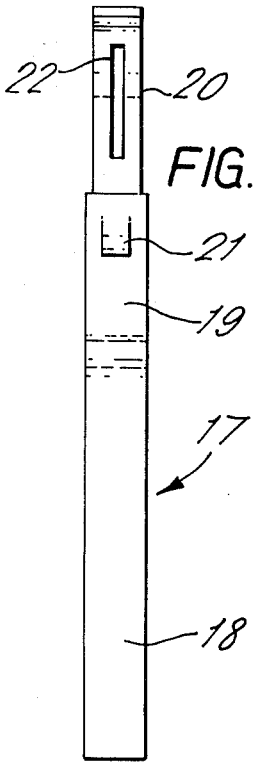
FIG. 3.
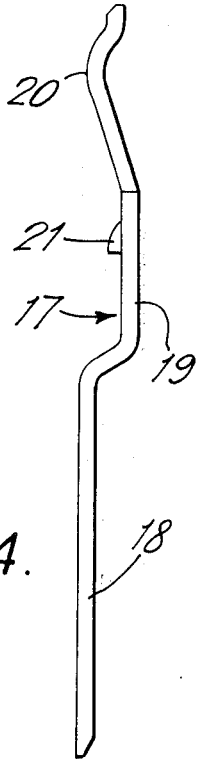
FIG. 4.

METHOD OF MANUFACTURING AN ELECTRICAL CONNECTOR

This invention relates to a method of manufacturing an electrical connector comprising a housing of electrically insulating material and at least one electrical contact having a first part lying on a substantially planar surface of the housing, a second part received in a slot in the housing, and a third part projecting from the slot in the direction away from the first part.

Such connectors including a plurality of electrical contacts are used for establishing connections to printed circuit boards, the third part of each contact constituting part of a receptacle for an edge of a printed circuit board, and the first part of each contact constituting a plug for reception in a mating receptacle such as a contact of a printed circuit board edge connector.

Normally such connectors comprise a one-piece housing and are manufactured by inserting the first part of the contact through the slot in the housing onto the planar surface of the housing. The contact normally has a projection on its second part, which projection engages a surface of the housing to retain the contact in position relative to the housing.

A difficulty which arises with such a method of manufacture is that the contact can become damaged as it is mounted in the housing, this often resulting in that the first part of the contact does not lie flat on the planar surface of the housing. Further, with such a method of manufacture it is difficult to give the contact an inherent bias serving to hold the first part of the contact on the planar surface of the housing after assembly of the connector.

According to this invention a method of manufacturing an electrical connector of the type discussed above includes the steps of arranging the contact on a first housing part providing the planar surface and part of the periphery of the slot, and bonding a second housing part to the first housing part thereby to complete the slot in the housing and secure the contact to the housing.

Preferably the bonding is effected by ultrasonic welding, the housing parts each being formed with ribs which initially contact the other housing part and which become fluid during the welding operation and thereafter set to secure the housing parts together.

The method of this invention has the advantage that the contact can be mounted on the first housing part easily and without fear of damaging the contact or the first housing part, the contact preferably being merely laid on the first housing part with the first part of the contact superposed on the planar surface of the housing.

The method of this invention also gives the further advantage that the contact can be given an initial form which is such that during bonding of the housing parts together the contact becomes stressed and thereafter retains an inherent resilient bias serving to hold the first part of the contact on the planar surface of the housing.

It will be appreciated that the method of this invention can be used to manufacture a connector comprising a plurality of contacts and a single common housing, the second parts of the contacts being received in individual slots in the housing.

Preferably for such a connector the contacts are initially carried by a common carrier strip whereby they can be all simultaneously mounted on the first housing part, the carrier strip being positioned to remain outside the housing when completed whereby the carrier strip can be removed after manufacture of the connector, to isolate the contacts from each other.

Further, the first part of the housing can be formed with two substantially planar surfaces on opposite sides of a portion of the housing part, and with parts of the periphery of two slots individually associated with the two planar surfaces, whereby by the provision of two second housing parts two contacts can be mounted in the housing with their first parts on the two planar surfaces respectively, and their third parts together forming an electrical receptacle, for example for making contact to both sides of a printed circuit board mated with the connector.

The method of this invention will now be described by way of example with reference to the drawings, in which:

FIG. 1 is a perspective view of a first housing part of a connector to be manufactured by the method;

FIG. 2 is a perspective view of a second housing part for use with the first housing part of FIG. 1, two such second housing parts being required to complete the connector;

FIG. 3 is a plan view, to a larger scale, of a contact for use with the housing parts of FIGS. 1 and 2;

FIG. 4 is a side elevation of the contact of FIG. 3;

Figure 5:
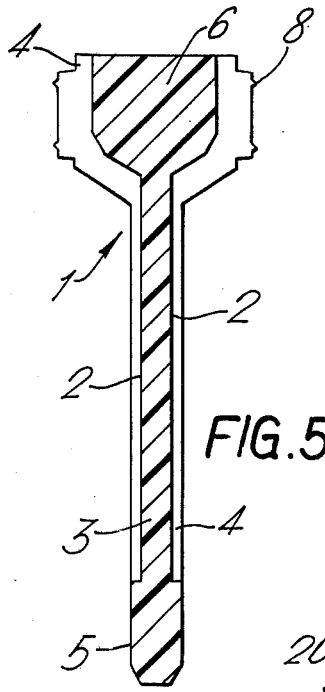
FIG. 5 is a cross-section through the housing part of FIG. 1.

Referring to the drawings, the first housing part 1 shown in FIGS. 1 and 5 is molded from electrically insulating material such as a thermoplastic polyester material. The part 1 has a plurality of coplanar surfaces 2 on each of two opposite sides of a portion 3 of the part 1, the surfaces 2 being separated from each other by ribs 4, and bounded by a peripheral rib 5. The portion 3 of the part 1 extends from a larger thickness portion 6 over which the ribs 4 and 5 extend, as best seen in FIG. 1. The surface of the portion 6 and adjacent ribs 4 or 4 and 5 together provide part of the periphery of a slot 7 (FIG. 7) in which part of a contact will be received, as will be described later. The ribs 4 where they pass over the portion 6 of the part 1, are provided with projections 8 the purpose of which will also be described later.

Figure 6:
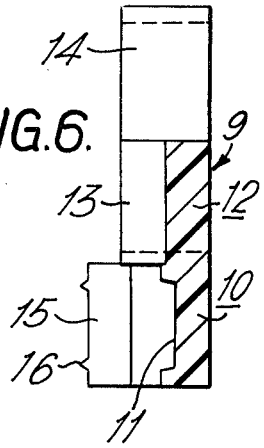
FIG. 6 is a cross-section through the housing part of FIG. 2.

The second housing part 9 shown in FIGS. 2 and 6, is molded from the same material as the part 1, and comprises a first elongate portion 10 having a plurality of recesses 11 therein, and a second elongate portion 12 having a plurality of upstanding walls 13. At either end of the portions 10 and 12 is an apertured lug 14 and a rectangular boss 15 formed with projections 16.

Figure 7:
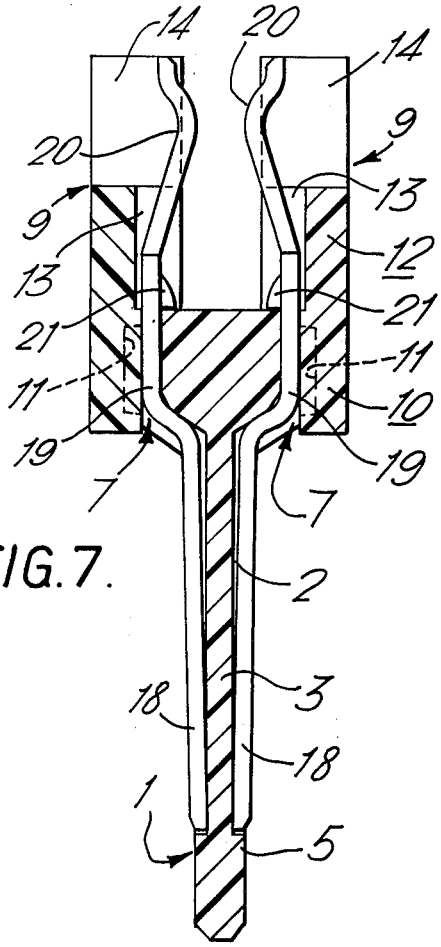
FIG. 7 is a cross-section through a connector manufactured from the housing parts and contact of FIGS. 1 to 6.

The part 9 is shaped to be mounted on the part 1, as shown in FIG. 7, with the projections 8 of the part 1 received in the recesses 11 of the part 9 such that surfaces of the portion 10 of the part 9 between the recesses 11 complete the periphery of the slot 7 (FIG. 7). As shown in FIG. 7, two parts 9 are mounted on opposite sides of the part 1 with their walls 13 aligned. Only one of the parts 9 is formed with the projections 16 which come into contact with the surface of the bosses 15 of the other part 9.

Referring now to FIGS. 3 and 4, the contact 17 here shown is stamped and formed from an electrically conductive metal such as brass, to have a first part 18 which, as shown in FIG. 7, is to lie on a surface 2 of the housing part 1, a second part 19 to be received in the slot 7 (FIG. 7) of the housing, and a third part 20 arranged to project from the slot 7 in the direction away from the part 18. The third part 20 is formed with a slot 22 which is to serve as a solder reservoir when the part 20 is provided with a solder coating for subsequent soldering thereof to a further conductor. At the transition from the part 19 to the part 20 the contact 17 is formed with a projection 21 which, as shown in FIG. 7, is to engage the free end surface of the portion 6 of the housing part 1.

The contact 17 is initially formed with a plurality of similar contacts (not shown) carried by a common carrier strip (not shown) connected to the contacts at the free ends of their third parts 20.

To manufacture a connector from the housing parts and contacts described above, a commonly carried plurality of contacts 17 as described is arranged on each side of the first housing part 1 with the parts 18 of the contacts on the surfaces 2 of the housing part 1, as shown in FIG. 7. A second housing part 9 is then placed in position on each side of the housing part 1, as shown in FIG. 7, to complete the slots 7 in which the second parts 19 of the contacts 17 are received.

The loosely assembled parts are then introduced into an ultrasonic welding machine (not shown) which is then operated to urge the parts 9 towards the part 1 and weld the parts 9 and 1 together as shown in FIG. 7. During the welding operation the projections 8 on the housing part 1 become fluid and fill the recesses 11 of the housing parts 9, the material subsequently setting to secure the housing parts 9 and 1 together. Further, the projections 16 on the one part 9 also become fluid, and subsequently serve to secure the ends of the housing parts 9 together.

After the welding operation is completed, the carrier strips are removed from the contacts, the contacts 17 remaining secured in the housing each restrained against axial movement by engagement with the portion 6 of the housing part 1, and against lateral movement by the walls of the slot 7 in which the second part 19 of the contact 17 is received.

The contacts 17 are initially given a form such that when they are first arranged on the housing part 1 they engage this part 1 only at the tip of their first part 18 and at the projection 21, the second part 19 of the contact 17 remaining out of contact with the portion 6 of the housing part 1. During the welding operation the second part 19 of the contact 17 is urged into contact with the housing part 1 by the overlying housing part 9, and thus the contact 17 remains in a stressed condition in the completed connector, thus ensuring that the first part 18 of the contact 17, and particularly the tip thereof, remains on the surface 2 of the housing part 1. Further, due to the method of manufacture, there is virtually no chance of damaging the contacts 17 during manufacture as there would be if the contacts 17 were inserted through slots in a one-piece housing as with known methods of manufacture.

For use, the connector can be mounted on the edge of a printed circuit board, secured thereto by bolts passing through the apertures in the lugs 14 of the housing parts 9, and with the parts 20 of the contacts 17 in contact with, and possibly soldered to, conductors of the printed circuit board.

The portion 3 of the housing part 1 with the contact parts 18 thereon, can then serve as a plug for reception in a mating socket such as a printed circuit board edge connector.

It will be appreciated that the third parts 20 of the contacts 17 can have a form other than that shown, whereby they can be connected to other than a printed circuit board. For example, the parts 20 of the contacts 17 can be formed for connection to the conductors of a flat flexible cable such that the connector can be utilized to connect the cable to for example, a printed circuit board edge connector.

The method of manufacture of this invention gives the further advantage that the housing parts 9 can readily each be formed with part of a clamp device in place of the lugs 14, such that when the connector is connected to, for example, a flat flexible cable, the cable can be received between the clamp device parts which can then be secured together as by bolts thereby to clamp the connectors to the cable.

Such an arrangement cannot readily be achieved with known connectors having one-part housings.

What is claimed is:

1. An electrical connector comprising:

a. an elongated first housing part of insulating material having a thin portion depending from a cup shaped portion with a plurality of spaced vertical ribs extending along the two portions to provide a plurality of distinct coplanar surfaces;

b. a plurality of conductive contacts having a first elongated part and a second part with a transition part connecting the first and second parts, said first part positioned on a coplanar surface on the thin portion and the second part positioned over and extending above the cup shaped portion, and the transition part positioned over the junction of the thin portion and cup shaped portion; and c. two second housing parts each having an elongated portion with a plurality of upstanding spaced walls across the upper section thereof, said second housing parts secured to either side of the cup shaped portion on the first housing part so that the upstanding walls are positioned on top of the cup shaped portion and the lower section presses in on the lower half of the second part of the contacts to thereby provide a bias against the contacts to hold the first parts thereof against the coplanar surfaces of the housing.

2. A method of manufacturing an electrical connector comprising a housing of electrically insulating material and at least one electrical contact having a first part lying on a substantially coplanar surface of the housing, a second part received in a slot in the housing and a third part projecting from the slot in the direction away from the first part, including the steps of arranging the contact on a first housing part providing a coplanar surface and part of the periphery of the slot, and bonding a second housing part to the first housing part to stress the contact whereby the first part of the contact is resiliently biased against the coplanar surface of the first housing part.

3. A method as claimed in claim 2, for manufacturing a connector comprising a plurality of contacts and a single common housing, the second parts of the contacts being received in individual slots in the housing, in which the contacts are initially carried by a common carrier strip and are all simultaneously mounted on a first housing part, the second housing part thereafter being bonded to the first housing part with the carrier strip remaining outside the housing, and the carrier strip then being removed to isolate the contacts from each other.

* * * * *